US005989493A

United States Patent [19]

La Salle et al.

[11] Patent Number: 5,989,493

[45] Date of Patent: Nov. 23, 1999

[54] NET SHAPE HASTELLOY X MADE BY METAL INJECTION MOLDING USING AN AQUEOUS BINDER

[75] Inventors: Jerry C. La Salle, Montclair; Bryan C. Sherman, Mine Hill, both of N.J.

[73] Assignee: AlliedSignal Inc., Morris Township, N.J.

[21] Appl. No.: 09/143,137

[22] Filed: Aug. 28, 1998

[51] Int. Cl.[6] ..... B22F 3/10

[52] U.S. Cl. ..... 419/36; 419/37; 419/54; 419/58; 75/246

[58] Field of Search ..... 419/36, 37, 54, 419/58; 75/246

[56] References Cited

U.S. PATENT DOCUMENTS

| | | | |
|---|---|---|---|
| 4,734,237 | 3/1988 | Fanelli et al. | 264/122 |
| 5,258,155 | 11/1993 | Sekido et al. | 264/109 |
| 5,286,767 | 2/1994 | Rohrbach et al. | 524/27 |
| 5,332,537 | 7/1994 | Hens, et al. | 264/22 |
| 5,397,520 | 3/1995 | Rohrach et al. | 264/122 |
| 5,746,957 | 5/1998 | Fanelli et al. | 264/109 |
| 5,830,305 | 11/1998 | Anderson et al. | 156/242 |

OTHER PUBLICATIONS

J.J. Valencia, et al., Superalloys 718,625,706, The Minerals, Metals & Materials Society, 1994

*Primary Examiner*—Ngoclan Mai
*Attorney, Agent, or Firm*—John A. Squires

[57] ABSTRACT

A molding compound consisting of the nickel superalloy Hastelloy X is used to form net-shape or near net-shape articles. The compound, containing atomized Hastelloy X powder having an average particle size less than about 20 μm, is mixed with a liquid carrier, a gel forming binder and processing additives and molded at relatively low pressures in a conventional injection molding machine. A critical air debinding step prior to sintering results in high densification of the article, which has mechanical properties comparable to cast or wrought processed material.

14 Claims, 2 Drawing Sheets

NET SHAPE HASTELLOY X MADE BY METAL INJECTION MOLDING USING AN AQUEOUS BINDER

FIELD OF THE INVENTION

This invention relates to a process for the production of net and near net shape components from nickel-based superalloy Hastelloy X powder. More particularly, the invention is directed to a debinding and sintering schedule that produces components for aerospace and other structural applications. Such components are made by the net shape process of metal injection molding using an aqueous based feedstock binder.

BACKGROUND OF THE INVENTION

DESCRIPTION OF THE PRIOR ART

Hastelloy X is a nickel-chromium-iron-molybdenum alloy that possesses an exceptional combination of oxidation resistance and high temperature strength. It has wide use in gas turbine engines for combustion zone components such as transition ducts, combustor cans, spray bars and flame holders as well as in afterburners, tailpipes and cabin heaters. It is also used in industrial furnace applications because it has unusual resistance to oxidizing, reducing and neutral atmospheres.

Hastelloy X is typically available in cast or wrought forms but is also available as a powder metallurgy (PM) product. Conventional PM processing of Hastelloy X includes press and sinter, which results in compacts limited to simple geometric shapes such as cylinders that are not fully dense. Additional processing, such as hot isostatic pressing (HIP), can bring densities to near 100% of theoretical density.

Metal-injection-molding(MIM) is recognized as a premier forming method for complex, shapes. It affords significant advantages over other forming methods due to its capability of rapidly producing net shape, complex parts in high volume. Initially, MIM comprised the step of mixing metal powder with a dispersant and a thermoplastic organic binder of variable composition. The molten powder/binder mixture was heated during the injection molding process and injected into a relatively cold mold. After solidification, the part was ejected in a manner similar to injection molded plastic parts. Subsequently, the binder was removed and the part was densified by a high temperature heat treatment. There were a number of critical stages in this process, which included the initial mixing of the powder and binder, the injection of the mixture into the mold, and the removal of the organic matrix material used as the binder. One of the main disadvantages of the initial MIM process is the removal of the organic vehicle. Currently, with organic binder MIM processes, the cross section limit of a part for fine particle sizes is typically less than ¼ inch. If the cross section of the part exceeds that limit, the binder removal process will lead to defects, pinholes, cracks, blisters, etc. Binder removal takes place by slow heat treatments that can take up to several weeks. During debinding at elevated temperatures, the binder becomes a liquid, which can result in distortion of the green part due to capillary forces. Another disadvantage of the initial MIM process is the tendency for the relatively high molecular weight organic to decompose throughout the green body, causing internal or external defects. The use of solvent extraction, wherein a portion of the organic is removed using an organic or supercritical liquid, sometimes minimizes defect formation. Solvent extraction causes difficulties because the remainder still needs to be removed at elevated temperatures, resulting in the formation of porosity throughout the part, which facilitates removal of the remaining organic material. During binder removal, part slumping can pose problems, especially for the larger particle sizes if the green density/strength is not high enough.

MIM offers certain advantages for high volume automation of net shape, complex parts. However, the limitation of part size and the excessive binder removal times, along with a negative environmental impact resulting from the debinding process have inhibited the expected growth of the use of this technique.

Some improvements, such as the use of water based binder systems, have been made to the initial MIM process. Hens et al. developed a water leachable binder system as described in U.S. Pat. No. 5,332,537. The injection molding feedstock is made with a tailored particle size distribution (to control the rheology), a PVA-based majority binder, and a coating on each of the binder particles. During molding, these coatings form necks which give the part rigidity. After injection molding, there is a water debind that lasts several hours. After the remaining binder is cross-linked by either UV or chemical methods, the part undergoes a thermal debind, which takes 8–12 hours for a part such as a golf club head. Other aqueous-based binders contain either polyethylene glycols, PVA copolymers, or COOH-containing polymers. BASF has developed a polyacetal-based system that is molded at moderately high temperatures after which the binder is removed by a heat treatment with gaseous formic or nitric acid. The acid treatment keeps the debind temperature low to exclude the formation of a liquid phase and thus distortion of the green part due to viscous flow. The gaseous catalyst does not penetrate the polymer, and the decomposition takes place only at the interface of the gas and binder, thereby preventing the formation of internal defects. These improvements are limited by the requirement for separate binder removal furnaces and times, depending on the part size. There are environmental issues as well with removal of the large amount of wax/polymer in the form of fire hazards and volatile organic compound discharge.

An injection molding process using agar as an aqueous binder has been developed by Fanelli et al, as described in U.S. Pat. No. 4,734,237. This binder system applies to both ceramic and metal powders. It also includes the use of agarose or derivatives of polysaccharide aqueous gels. The advantage over state-of-the-art wax-based binder technology is the use of water as the fluid medium versus wax. In feedstocks prepared according to this technology, water serves the role of the fluid medium in the aqueous injection molding process, comprising roughly 50 volume % of the composition, and agar provides the "setting" function for the molded part. The agar sets up a gel network with open channels in the part, allowing easy removal of the water by evaporation. By contrast the Hens et al system requires a solvent debind to attain similar open channels in the part. The agar is eventually removed thermally; however, it comprises less than 5 volume fraction of the total formation, and debind times are rapid compared to wax/polymeric debind systems. This is an advantage over the Hens et al system.

This agar based aqueous binder is especially applicable for the production of stainless steel components using MIM. Due to the easy removal of the aqueous based binder and its relatively low level of carbon, as compared to wax or polymeric binder systems, debinding and sintering schedules have been developed by Zedalis et. al (U.S. patent application Ser. No. 09/141,444) which impart little or no additional carbon to stainless steel alloys such as 316L, 410 and 17-4PH. Moreover, the agar based binder and its associated carbon are removed in a simple one step, air debind consisting of relatively short debind times of approximately ½ to 2 hours. In contrast, wax or polymer based binders require several step debinding processes in which each debind step often takes many more hours. Accordingly, the short air debind times of the agar-based feedstocks are economically advantageous.

Nickel based alloys have not traditionally been exploited using MIM processing. Valencia et al ("Superalloys 718, 625, 706 And Various Derivatives"; E. A. Loria; *Minerals, Metals And Materials Society,* 1994; page 935) have applied the wax/polymer binder systems to MIM of the nickel superalloys 625 and 718 and have reported acceptable mechanical properties. However, production of those components suffered from the limitations of the wax/polymer debind system, i.e. long debind times resulting in uneconomical processing and part size limitations.

BRIEF SUMMARY OF THE INVENTION

The present invention relates to a debinding and sintering process for an article of manufacture made from Hastelloy X alloy powder and an aqueous binder in an injection molding process comprising the steps of raising the temperature of an air atmosphere to a value sufficient to decompose the polysaccharide in the aqueous binder, and then sintering at elevated temperatures in a hydrogen atmosphere to reduce oxidation formed on the article during the debinding step.

This invention is also directed to an injection molding process for forming an article from Hastelloy X alloy powder comprising the following steps:

a) injecting a mixture comprising
   1) Hastelloy X alloy powder, and
   2) a gel-forming aqueous binder into a mold, the temperature of the mixture prior to injection being maintained at a first level above the gel point of the binder, b) cooling the mixture in the mold to a second level below the gel point of the binder to form a self-supporting article, c) debinding the article in an air atmosphere by raising the temperature to a value sufficient to decompose the polysaccharide in the aqueous binder, and d) sintering the article in a hydrogen atmosphere at elevated temperatures sufficient to reduce any oxidation formed on the article during the debinding step.

The invention further provides a critical air debinding step prior to sintering which results in high densification of Hastelloy X. In addition to the critical air debind step, this invention also discloses other sintering parameters such as peak sintering temperature and hold time, which in conjunction with the air debind step, are important in producing Hastelloy X components having mechanical properties comparable to cast or wrought processed material.

DETAILED DESCRIPTION OF THE INVENTION

The following examples are presented to provide a more complete understanding of the invention. The specific techniques, conditions, materials, proportions and reported data set forth to illustrate the principles and practice of the invention are exemplary and should not be construed as limiting the scope of the invention.

EXAMPLE 1

This example describes the criticality of an air debinding step prior to sintering in order to maximize density in agar-based MIM processing of Hastelloy X alloy. Hastelloy X feedstock was compounded using argon atomized Hastelloy X powder of minus 20 micrometer size purchased from Ultrafine Metals, Inc. The Hastelloy X powder was mixed with agar (S-100, Frutarom Meer Crop.), water, and calcium borate to have the composition (in wt %) of 92.5% Hastelloy, 1.7% agar, 5.7% water, and 0.1% calcium borate. Compounding was performed in a sigma blender that was heated to 88° C. for 45 minutes, after which the temperature was reduced to 77° C. and mixing continued for another 45 min. After the material was allowed to cool to room temperature, it was shredded using a food processor (Kitchen Aid KSM90) and sieved using a #5 sieve to remove any large and fine shards. Before being molded, the shredded feedstock material was dried to desired solids level by exposing a loose bed of shredded feedstock material to the atmosphere. Solids loadings were determined using a moisture balance (Ohaus Corp.). Injection molding of the feedstock into tensile specimens was next performed on a 55 ton Cincinnati Milacron injection molding machine at 85° C., using a fill pressure of 200 psi, and a mold pressure of 100 psi, by forming the feedstock into an epoxy tensile bar mold. Such parts, after injection molding but before sintering, are referred to as "green" parts.

The tensile bars were next divided into sixteen batches and run in a 4 factor-2 level fractional factorial design of experiment(DOE), which was analyzed by MINITAB statistical software. The four factors used as inputs and their levels are summarized in Table I. The output value for the analysis is % theoretical density, with high density being the desired result. A total of eight experimental debind/sintering runs were performed in a laboratory tube furnace. The MINITAB statistical software was then utilized to determine the factors important for the maximization of density in the debinding and sintering operation of the agar-based aqueous Hastelloy X tensile bars.

TABLE I

| Factor | Low Value | High Value |
|---|---|---|
| Debind temperature | 225° C. | 300° C. |
| Sintering atmosphere | Argon | Hydrogen |
| Sintering Temperature | 1200° C. | 1287° C. |
| Sintering Time | 1 hour | 4 hours |

Figure 1:
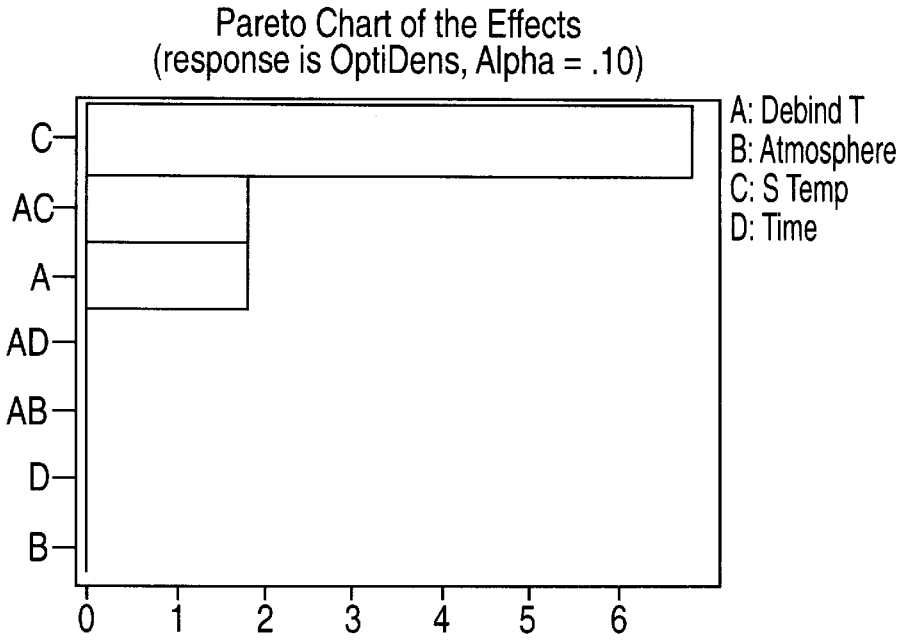
FIG. 1 are Paretto and Main Effects plots from the Statistical Software Package MINITAB, which show that of the four factors tested, the Sintering Temperature and Air Debind Temperature are the most significant significant factors in maximizing density in excess of 98%.
Figure 1:
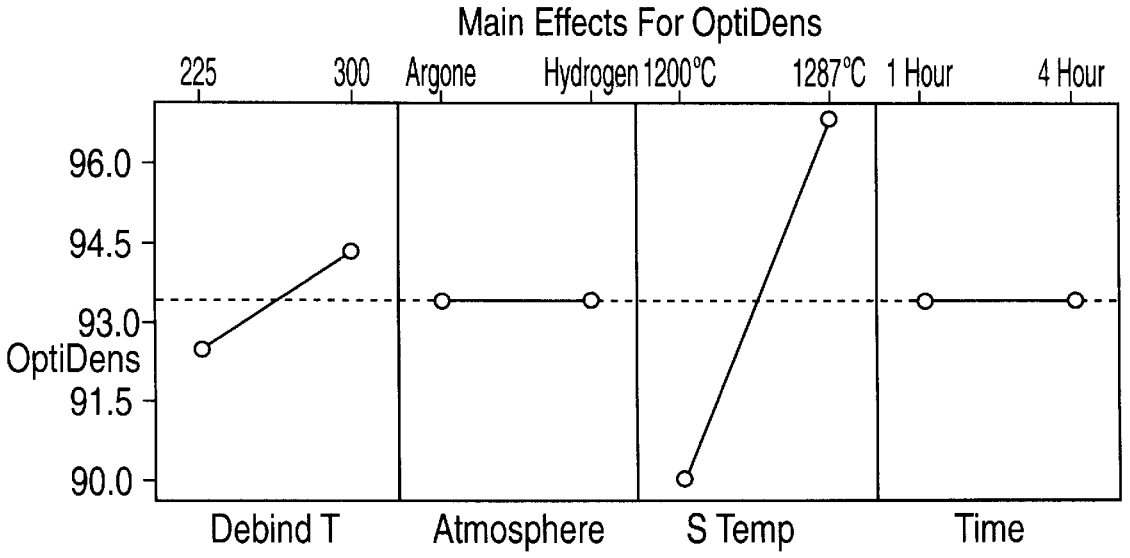

FIG. 1 shows the Main Effects and Paretto chart from the MINITAB statistical software. In the Paretto chart factors appearing to the right of the vertical line indicate statistical significance. The Paretto chart clearly indicates that main factors for densification are the sintering temperature and the air debind temperature. Sintering atmosphere and sintering time have a minimal effect on density. The magnitude of the effects is shown in the Main Effects plot in FIG. 1, which shows that air debinding at 225° C. and a 1287° C. sintering temperature can result in as-sintered densities >98%.

EXAMPLE 2

Figure 2:
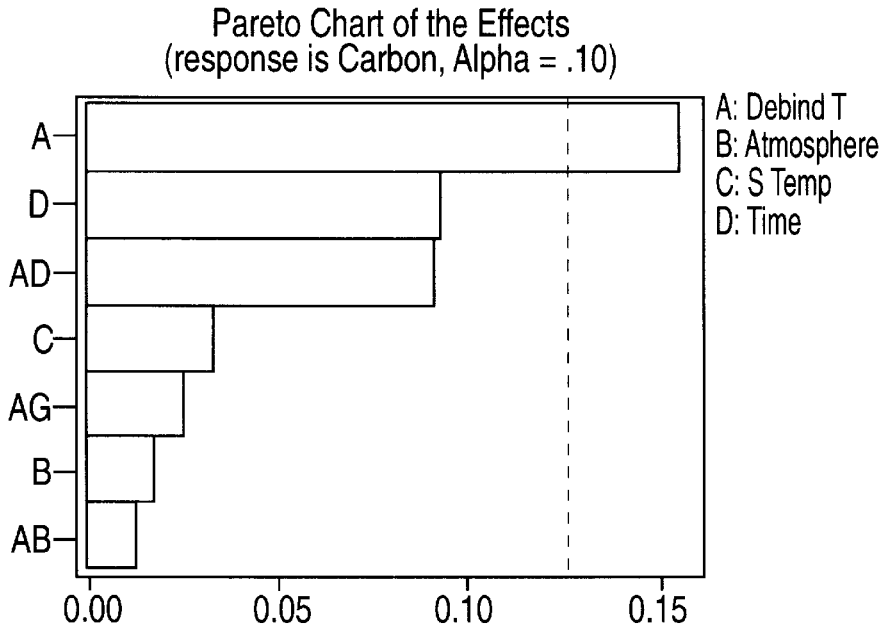
FIG. 2 are similar plots showing that Air Debind Temperature is the most significant factor in maximizing tensile elongation in unHIPed Hastelloy X.
Figure 2:
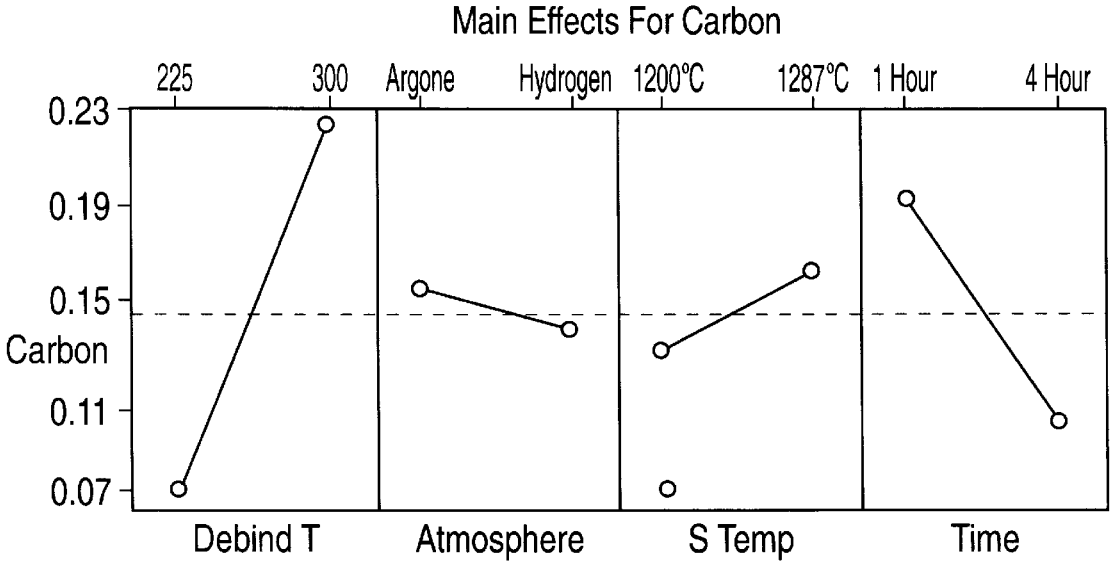

This example describes the criticality of an air debinding step prior to sintering for Hastelloy X in order to maintain carbon levels in the range of 0.1%. Samples were prepared and analyzed using MINITAB, as described in Example 1. The Paretto and Main Effects plots using the as-sintered carbon level as an output are shown in FIG. 2. The Paretto chart indicates that the air debind temperature is the only significant factor for controlling carbon to below 0.1 wt % within the factors and levels analyzed in this DOE. Examination of the Main Effects plots shows that the 225° C. air debind temperature results in carbon levels below 0.1 wt %

EXAMPLE 3

This examples shows that a debinding and sintering process using the optimized parameters from the 4 factor DOE described in Example 1 can be incorporated in a one step sintering cycle using a vacuum chamber. Net shape Hastelloy X green tensile bars were air debound and sintered to a 99% theoretical density in a vacuum chamber during a one step cycle. During the initial portion of the cycle, the bars were debound in an air atmosphere at a partial pressure of 200 Torr at 260° C. for 1 hour. The chamber was then evacuated and refilled with hydrogen to a pressure of 200 Torr, while the temperature was ramped to the peak sintering temperature of 1260° C. The samples were held at that temperature for 45 minutes. Total cycle time in the vacuum chamber was approximately 14 hours including the cool down to room temperature. Solutionization was performed at 1177° C. for 1 hour followed by a rapid air quench. The tensile properties are listed in Table II. Wrought properties listed in Table II are from the Haynes Corporation Hastelloy X Datasheet. This example also illustrates that control of carbon, oxygen and nitrogen is maintained in this debinding and sintering cycle. The C, O, and N values were measured at 0.0624, 0.004, and 0.0018% respectively. Carbon is specified at less than 0.1 wt % for Hastelloy X.

TABLE II

| Sample # | YS (ksi) | UTS (ksi) | El (%) |
|---|---|---|---|
| J6 | 35.1 | 77.4 | 37.8 |
| J5 | 32.6 | 67.3 | 28.0 |
| J7 | 35.6 | 80.2 | 44.7 |
| Average | 34.4 | 75.0 | 36.8 |
| Std. Deviation | 1.6 | 6.8 | 8.4 |
| Wrought | 49.0 | 108.0 | 51.0 |

EXAMPLE 4

This example illustrates the beneficial effect of using a HIP treatment after sintering but before solutionization on material otherwise treated in Example 3. The HIP treatment employed was a standard industrial HIP treatment consisting of a 15 ksi argon pressure at 1160° C. for 4 hours after sintering. Table III lists the tensile properties.

TABLE III

| Sample | YS (ksi) | UTS (ksi) | El (%) |
|---|---|---|---|
| J2 | 43.37 | 97.01 | 78.20 |
| J12 | 43.18 | 96.25 | 76.64 |
| 1C | 44.53 | 97.83 | 72.01 |
| H | 44.62 | 99.65 | 68.29 |
| Average | 43.9 | 97.7 | 73.8 |
| Std. Deviation | 0.8 | 1.5 | 4.5 |
| Wrought | 49.0 | 108.0 | 51.0 |

Having thus described the invention in rather full detail, it will be understood that such detail need not be strictly adhered to but that various changes and modifications may suggest themselves to one skilled in the art, all falling within the scope of the invention as defined by the subjoined claims.

What is claimed is:

1. A process for debinding and sintering an article of manufacture made in an injection molding process from Hastelloy X alloy powder and an aqueous binder comprising the steps of:

a) in an air atmosphere debinding the article by raising the temperature to a value sufficient to decompose the polysaccharide in the aqueous binder;

and b) in a hydrogen atmosphere sintering the article at elevated temperatures to reduce any oxidation formed on the article during the debinding step.

2. The process of claim 1, wherein the temperature in the debinding step is below 300° C.

3. The process of claim 2, wherein the temperature in the debinding step is about 225° C.

4. The process of claim 2, wherein the temperature in the sintering step is between about 1200° C. and about 1287° C.

5. An injection molding process for forming an article from Hastelloy X alloy powder comprising the steps of:

a) injecting a mixture comprising (1) Hastelloy X alloy in powder form, and (2) a gel-forming aqueous binder consisting of a polysaccharide material into a mold, the mixture being maintained prior to the injection step at a first temperature above the gel point of the binder;

b) cooling the mixture in the mold to a second temperature below the gel point of the binder to form a self-supporting article;

c) debinding the article in an air atmosphere by raising the temperature to a value sufficient to decompose the polysaccharide in the aqueous binder;

and d) sintering the article in a hydrogen atmosphere at elevated temperatures to reduce any oxidation formed on the article during the debinding step.

6. The process of claim 5, wherein the polysaccharide material is agar.

7. The process of claim 5, wherein the temperature during the debinding step is below 300° C.

8. The process of claim 7, wherein the temperature in the debinding step is about 225° C.

9. The process of claim 8, wherein the temperature in the sintering step is between about 120° C. and about 1287° C.

10. An article of manufacture produced by the process of claim 5.

11. The article of manufacture of claim 10, wherein the density of the article is in excess of about 99% of theoretical density.

12. The article of manufacture of claim 10, wherein the carbon level of the article is below about 0.10 wt %.

13. The article of manufacture of claim 10, wherein the oxygen level of the article is below about 0.002 wt %.

14. The article of manufacture of claim 10, wherein the article has tensile properties of about 44 ksi yield strength, about 98 ksi unit tensile strength, and about 74% elongation.

* * * * *